US010056049B2

(12) United States Patent
Han et al.

(10) Patent No.: US 10,056,049 B2
(45) Date of Patent: Aug. 21, 2018

(54) DISPLAY APPARATUS AND METHOD OF OPERATING THE SAME

(71) Applicant: SAMSUNG DISPLAY CO., LTD., Yongin-si, Gyeonggi-Do (KR)

(72) Inventors: Sangsu Han, Hanam-si (KR); Kyoung Won Lee, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/130,518

(22) Filed: Apr. 15, 2016

(65) Prior Publication Data

US 2017/0004787 A1 Jan. 5, 2017

(30) Foreign Application Priority Data

Jun. 30, 2015 (KR) ..... 10-2015-0093349

(51) Int. Cl.
*G09G 3/36* (2006.01)
*G09G 3/20* (2006.01)

(52) U.S. Cl.
CPC ..... *G09G 3/3614* (2013.01); *G09G 3/2022* (2013.01); *G09G 3/3611* (2013.01); *G09G 2330/021* (2013.01); *G09G 2360/16* (2013.01)

(58) Field of Classification Search
CPC ..... G09G 3/3611; G09G 3/3614
USPC ..... 345/99–100
See application file for complete search history.

(56) References Cited

U.S. PATENT DOCUMENTS

2010/0231564 A1* 9/2010 Min ..... G09G 3/3648 345/209
2010/0253611 A1* 10/2010 Takagi ..... G09G 3/3611 345/98
2010/0289828 A1* 11/2010 Lee ..... G09G 3/3614 345/690

FOREIGN PATENT DOCUMENTS

KR 1020030016717 3/2003
KR 1020030054898 7/2003
KR 1020040069015 8/2004
KR 1020140004497 1/2014
KR 1020140122123 10/2014

* cited by examiner

*Primary Examiner* — Roy P Rabindranath
(74) *Attorney, Agent, or Firm* — F. Chau & Associates, LLC

(57) ABSTRACT

A display apparatus includes a timing controller and a display panel. The timing controller generates output image data based on input image data and generates a polarity control signal by analyzing the input image data. The display panel displays a plurality of frame images based on the output image data during a plurality of frames and operates based on an inversion driving scheme in which a polarity pattern of the plurality of frame images is changed based on the polarity control signal per N frames, where N is a natural number. The number N is variable based on the polarity control signal.

17 Claims, 10 Drawing Sheets

FIG. 4A

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4B

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

DISPLAY APPARATUS AND METHOD OF OPERATING THE SAME

CROSS-REFERENCE TO RELATED APPLICATION

This application claims priority under 35 USC § 119 to Korean Patent Application No. 10-2015-0093349, filed on Jun. 30, 2015 in the Korean Intellectual Property Office (KIPO), the contents of which are herein incorporated by reference in their entirety.

TECHNICAL FIELD

Exemplary embodiments relate generally to display systems, and more particularly to display apparatuses that are used as one of input/output (I/O) devices and methods of operating the display apparatuses.

DISCUSSION OF RELATED ART

A flat panel display (FPD) may use different types of technology. For example, a FPD may use a liquid crystal display (LCD) panel, a plasma display panel or an organic light emitting display (OLED).

The display apparatus may be used in various mobile devices, such as a mobile phone, a smart phone, a tablet computer, a personal digital assistant (PDA), etc.

SUMMARY

According to exemplary embodiments, a display apparatus includes a timing controller and a display panel. The timing controller generates an output image data based on an input image data and generates a polarity control signal by analyzing the input image data. The display panel displays a plurality of frame images based on the output image data during a plurality of frames and changes a polarity pattern of the plurality of frame images based on the polarity control signal for each of N frames. N is a natural number and varies based on the polarity control signal.

The timing controller may generate an inversion control signal based on a type of image displayed on the display panel based on the output image data and may generate the polarity control signal based on the inversion control signal. The number N may be changed by adjusting a transition time of the polarity control signal based on the inversion control signal.

In an exemplary embodiment, when the output image data corresponds to a dynamic image, the display panel may display first frame images during first frames and may display second frame images during second frames subsequent to the first frames. There are X first frame images and X first frames, where X is a natural number equal to or greater than two, each of the first frame images may have a first polarity pattern, and the X first frames may be consecutive. There are Y second frame images and Y second frames, where Y is a natural number equal to or greater than two, each of the second frame images may have a second polarity pattern different from the first polarity pattern, and the Y second frames may be consecutive.

In an exemplary embodiment, when the output image data corresponds to the dynamic image, the timing controller may transition the polarity control signal from a first level to a second level after a time duration corresponding to the first frames is elapsed, and may transition the polarity control signal from the second level to the first level after a time duration corresponding to the second frames is elapsed.

In an exemplary embodiment, when the output image data corresponds to a static image including a reference pattern, the display panel may display first frame images during first frames and may display second frame images during second frames, the second frames are subsequent to the first frames. Each of the X first frame images have a first polarity pattern, the X first frames may be consecutive, and X is a natural number equal to or greater than two. Each of the Y second frame images have a second polarity pattern different from the first polarity patter, Y second frames may be consecutive, and where Y is a natural number equal to or greater than two.

In an exemplary embodiment, when the output image data corresponds to a static image, the display panel may display a first frame image during a first frame and may display a second frame image during a second frame subsequent to the first frame. The first frame image may have a first polarity pattern, and the second frame image may have a second polarity pattern different from the first polarity pattern.

In an exemplary embodiment, when the output image data corresponds to the static image, the timing controller may change an operating frequency of the display panel from a first frequency to a second frequency. The second frequency is lower than the first frequency.

In an exemplary embodiment, the number N may be dynamically changed by a lapse of time.

In an exemplary embodiment, the timing controller may generate the polarity control signal based on a type of a first image displayed on the display panel by the output image data. The number N may increase when the first image is changed from a static image to a dynamic image, and may decrease when the first image is changed from the dynamic image to the static image.

In an exemplary embodiment, the timing controller may generate the polarity control signal based on an operating frequency of the display panel. The number N may increase when the operating frequency of the display panel increases, and may decrease when the operating frequency of the display panel decreases.

The timing controller may include an inversion policy setting unit and a polarity control signal generator. The inversion policy setting unit may generate an inversion control signal based on at least one of a type of an image displayed on the display panel by the output image data and an operating frequency of the display panel by the input image data. The polarity control signal generator may generate the polarity control signal based on the inversion control signal. The inversion policy may determine the type of image by analyzing the input image data. The number N may be changed by adjusting a transition time of the polarity control signal based on the inversion control signal.

In an exemplary embodiment, the timing controller may further include a static image detector. The static image detector may generate a flag signal to provide the flag signal to the inversion policy setting unit when the output image data corresponds to a static image.

In an exemplary embodiment, the timing controller may further include an operating frequency setting unit. The operating frequency setting unit may change an operating frequency of the display panel from a first frequency to a second frequency. The second frequency is lower than the first frequency when the output image data corresponds to a static image.

In an exemplary embodiment, the timing controller may further include an image processor. The image processor may generate the output image data by performing at least one image compensation on the input image data.

According to exemplary embodiments, in a method of operating a display apparatus, output image data is generated based on input image data. A polarity control signal is generated by analyzing the input image data. A plurality of frame images are displayed on a display panel during a plurality of frames. The display panel changes a polarity pattern of the plurality of frame images based on the polarity control signal for each of N frames. N is a natural number and is variable based on the polarity control signal.

In generating the polarity control signal, an inversion control signal may be generated based on a type of an image displayed on the display panel by the output image data. The polarity control signal may be generated based on the inversion control signal. The number N may be changed by adjusting a transition time of the polarity control signal based on the inversion control signal.

In an exemplary embodiment, when the output image data corresponds to a dynamic image, or when the output image data corresponds to a static image including a reference pattern, the display panel may display first frame images during first frames and may display second frame images during second frames. The second frames are subsequent to the first frames. Each of the X first frame images have a first polarity pattern, the X first frames may be consecutive, and X is a natural number equal to or greater than two. Each of the Y second frame images have a second polarity pattern different from the first polarity pattern, Y second frames may be consecutive, and where Y is a natural number equal to or greater than two.

In an exemplary embodiment, when the output image data corresponds to a static image, the display panel may display a first frame image during a first frame and may display a second frame image during a second frame subsequent to the first frame. The first frame image may have a first polarity pattern, and the second frame image may have a second polarity pattern different from the first polarity pattern.

In the method of operating the display apparatus, an operating frequency of the display panel may be further changed from a first frequency to a second frequency. The second frequency may be lower than the first frequency when the output image data corresponds to the static image.

In an exemplary embodiment, the number N may be dynamically changed by a lapse of time.

The display apparatus according to exemplary embodiments may operate based on the inversion driving scheme in which the polarity pattern of the frame images displayed on the display panel is changed per N frames, where N is a natural number. The number N may be variable based on at least one of the type of the image displayed on the display panel and the operating frequency of the display panel.

According to an exemplary embodiment, a display apparatus may include an image processor, an inversion policy setting circuit, a polarity control signal generator, a data driver and a gate driver. The image processor may generate an output image data based on an input image data. The inversion policy setting circuit may generate an inversion control signal based on at least one of the input image data and an input control signal. The polarity control signal generator may generate a polarity control signal by analyzing the input image data. The control signal generator may generate a first control signal and a second control signal based on the input control signal. The gate driver configured to receive the first control signal and to generate a plurality of gate signals. The gate driver applies the plurality of gate signals to a plurality of gate lines of a display panel. The data driver configured to receive the second control signal, the polarity control signal and the output image data and to generate a plurality of data voltages. The data driver applies the plurality of data voltages to a plurality of data lines of the display panel.

In an exemplary embodiment, the display panel may change a polarity pattern of a plurality of frame images based on the polarity control signal for each of N frames. The number N is a natural number and varies based on the polarity control signal.

In an exemplary embodiment, the inversion policy setting circuit may detect whether the type of image is one of a dynamic image or a static image based on the input image data or the input control signal. The inversion policy setting circuit may change the inversion control signal based on the type of image detected.

In an exemplary embodiment, the inversion policy setting circuit may change the number N if an image transmitted by the output image data has not modified for a period of time.

In an exemplary embodiment, the inversion policy setting circuit may detect whether the type of image is one of a dynamic image or a static image based on the input image data or the input control signal. The inversion policy setting circuit may change the inversion control signal based on the type of image detected.

In an exemplary embodiment, the inversion policy setting circuit may change the number N if an image transmitted by the output image data has not been modified for a period of time.

BRIEF DESCRIPTION OF THE DRAWINGS

Illustrative, non-limiting exemplary embodiments may be more clearly understood from the following detailed description taken in conjunction with the accompanying drawings.

FIGS. 4A and 4B illustrate examples of a polarity pattern of the frame image on the display apparatus.

DETAILED DESCRIPTION

Figure 1:
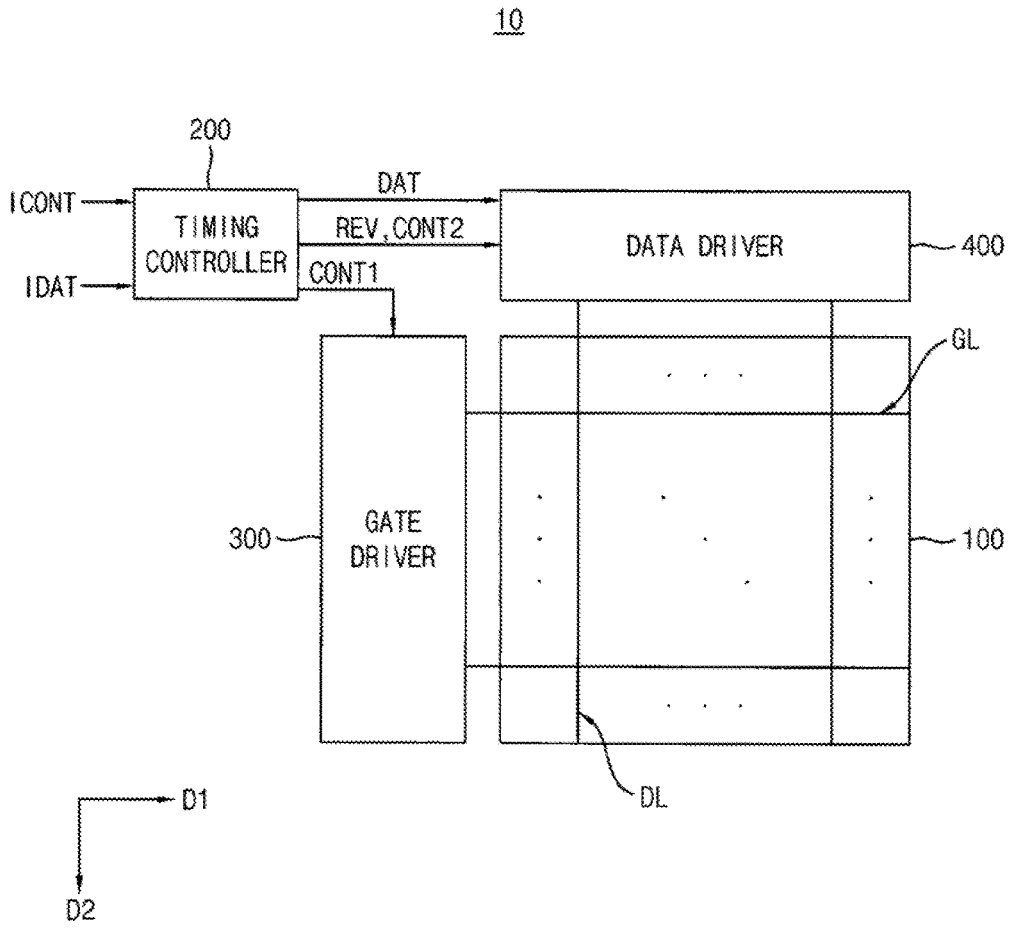
FIG. 1 is a block diagram illustrating a display apparatus according to exemplary embodiments.

Various exemplary embodiments will be described more fully with reference to the accompanying drawings. This inventive concept may be embodied in many different forms and should not be construed as limited to the embodiments set forth herein. Like reference numerals refer to like elements throughout this application.

FIG. 1 is a block diagram illustrating a display apparatus according to exemplary embodiments.

Referring to FIG. 1, a display apparatus 10 includes a display panel 100, a timing controller 200, a gate driver 300 and a data driver 400.

The display panel 100 is connected to a plurality of gate lines GL and a plurality of data lines DL. The gate lines GL may extend in a first direction D1, and the data lines DL may extend in a second direction D2 crossing and substantially perpendicular to the first direction D1.

The display panel 100 displays an image represented by a plurality of grayscales. For example, the display panel 100 displays a plurality of image frames based on the output image data DAT during a plurality of frames. The display panel 100 may display each image during each frame. One frame may indicate a time required to display one image frame on the display panel 100 and may be referred to as one image duration and/or one image period.

The display panel 100 may include a plurality of pixels that are arranged in a matrix form. Each pixel may be electrically connected to a respective one of the gate lines GL and a respective one of the data lines DL.

In some exemplary embodiments, each pixel may include a switching element, a liquid crystal capacitor and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls the operation of the display panel 100 and controls operations of the gate driver 300 and the data driver 400. The timing controller 200 receives input image data IDAT and an input control signal ICONT from an external device (e.g., a graphic processor). The input image data IDAT may include a plurality of input pixel data for the plurality of pixels. The input pixel data may include red grayscale data R, green grayscale data G and blue grayscale data B. The input control signal ICONT may include a master clock signal, a data enable signal, a vertical synchronization signal, a horizontal synchronization signal, etc.

The timing controller 200 generates the output image data DAT, a first control signal CONT1, a second control signal CONT2 and a polarity control signal REV based on the input image data IDAT and the input control signal ICONT.

The timing controller 200 may generate the output image data DAT based on the input image data IDAT. The output image data DAT may be provided to the data driver 400. In some exemplary embodiments, the output image data DAT may be image data that is substantially the same as the input image data IDAT. The output image data DAT may be compensated image data generated by compensating the input image data IDAT.

The timing controller 200 may generate the first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal ICONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

The timing controller 200 may generate the polarity control signal REV by analyzing the input image data IDAT. The display panel 100 operates based on an inversion driving scheme in which a polarity pattern of the plurality of frame images is changed (e.g., reversed) based on the polarity control signal REV. The polarity control signal REV is changed after a number of N frames, where N is a natural number. In other words, a polarity of a data voltage applied to each pixel may be reversed with respect to the common voltage based on the polarity control signal REV per a set or predetermined period (e.g., per N frames).

According to an exemplary embodiment, in the display apparatus 10, the number N is variable based on the polarity control signal REV. The number N may be associated with the number of changes in the polarity pattern of the frame images. Detailed configurations and operations of the timing controller 200 for changing the number N will be described below with reference to FIGS. 2, 3A, 3B, etc.

The gate driver 300 receives the first control signal CONT1 from the timing controller 200. The gate driver 300 generates a plurality of gate signals for driving the gate lines GL based on the first control signal CONT1. The gate driver 300 may sequentially apply the gate signals to the gate lines GL.

The data driver 400 receives the second control signal CONT2, the polarity control signal REV and the output image data DAT from the timing controller 200. The data driver 400 generates a plurality of analog data voltages based on the second control signal CONT2, the polarity control signal REV and the digital output image data DAT. The data driver 400 may apply the data voltages to the data lines DL.

In some exemplary embodiments, the data driver 400 may include a shift register, a latch, a signal processor and a buffer. The shift register may output a latch pulse to the latch. The latch may temporarily store the output image data, and may output the output image data to the signal processor. The signal processor may generate the analog data voltages based on the digital output image data and may output the analog data voltages to the buffer. The buffer may output the analog data voltages to the data lines DL.

In some exemplary embodiments, the gate driver 300 and/or the data driver 400 may be disposed, e.g., directly mounted, on the display panel 100, may be disposed on a non-display area adjacent to the display panel or may be connected to the display panel 100 in a tape carrier package (TCP) type. Alternatively, the gate driver 300 and/or the data driver 400 may be integrated on the display panel 100.

In some exemplary embodiments, the display apparatus 10 may further include a gamma reference voltage generator that generates a gamma reference voltage corresponding to a gamma curve. The data driver 400 may generate the data voltages based on the gamma reference voltage. The gamma reference voltage generator may be located inside or outside of the data driver 400.

Figure 2:
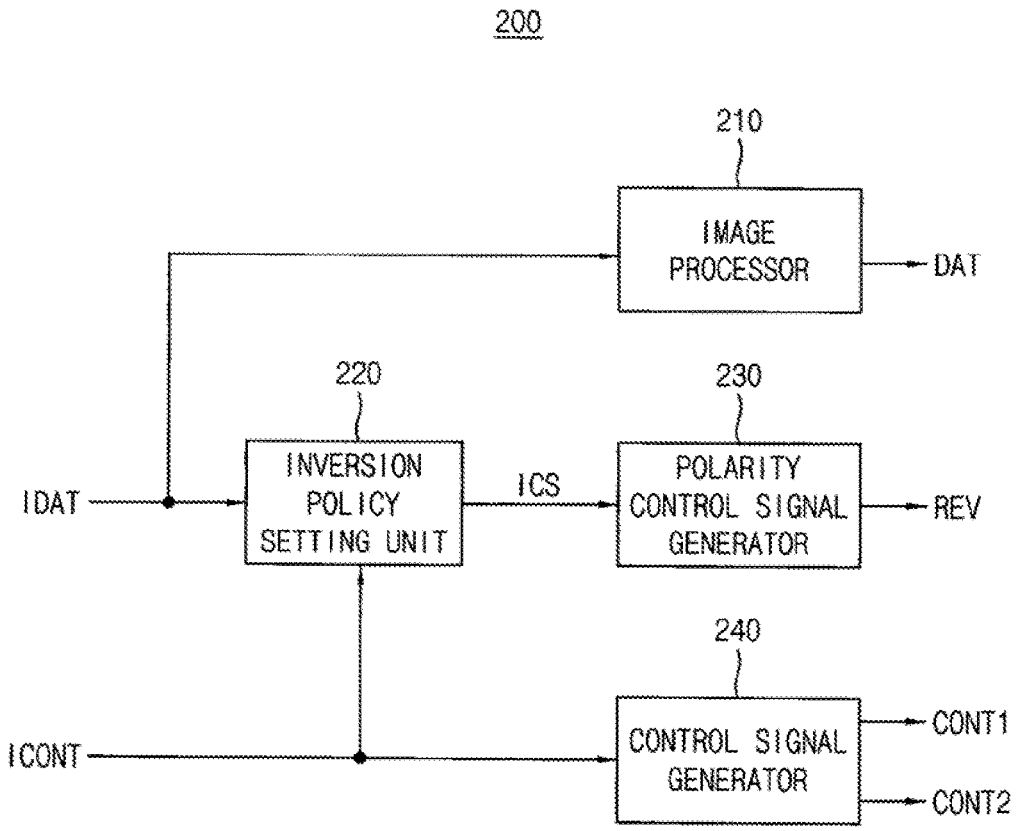
FIG. 2 is a block diagram illustrating a timing controller included in the display apparatus according to exemplary embodiments.

FIG. 2 is a block diagram illustrating a timing controller included in the display apparatus according to exemplary embodiments.

Referring to FIGS. 1 and 2, a timing controller 200 may include an image processor 210, an inversion policy setting unit 220, a polarity control signal generator 230 and a control signal generator 240. The timing controller 200 is illustrated in FIG. 2 as being divided into four elements for convenience of explanation. In an exemplary embodiment, the timing controller 200 may not be physically divided.

The image processor 210 may receive the input image data IDAT from the external device (e.g., the graphic processor). The image processor 210 may generate the output image data DAT by performing at least one image compensation on the input image data IDAT. For example, the image processor 210 may selectively perform an image quality compensation, a spot compensation, an adaptive color correction (ACC), and/or a dynamic capacitance compensation (DCC) on the input image data IDAT to generate the output image data DAT.

The inversion policy setting unit 220, e.g. the inversion policy setting circuit, may generate an inversion control signal ICS based on at least one of the input image data IDAT and the input control signal ICONT. The polarity control signal generator 230 may generate the polarity control signal REV based on the inversion control signal ICS.

The polarity pattern of the plurality of frame images that are displayed on the display panel 100 may be changed (e.g., reversed) based on the polarity control signal REV after N frames. The timing controller 200 may change the number N by adjusting a transition time of the polarity control signal REV based on the inversion control signal ICS.

In some exemplary embodiments, the number N may be changed based on a type of an image displayed on the display panel 100 by the output image data DAT. The inversion policy setting unit 220 may generate the inversion control signal ICS by analyzing the input image data IDAT, which corresponds to the output image data DAT.

For example, the inversion policy setting unit 220 may determine whether the output image data DAT corresponds to a dynamic image (e.g., a moving image, a video, etc.) or a static image (e.g., a still image, a stopped image, a photograph, etc.) to generate a first determination result, and may generate the inversion control signal ICS based on the first determination result. The number N may be changed based on the inversion control signal ICS. For example, the number N for the dynamic image may be greater than the number N for the static image.

For example, when the output image data DAT corresponds to the static image, the inversion policy setting unit 220 may further determine whether the static image includes a reference pattern (e.g., a predetermined test pattern, a pattern required to reduce power consumption, etc.) to generate a second determination result, and may generate the inversion control signal ICS based on the first and second determination results. The number N may be changed based on the inversion control signal ICS. For example, the number N for the static image including the reference pattern may be greater than the number N for the static image without the reference pattern.

In some exemplary embodiments, the number N may be changed based on an operating frequency of the display panel 100 (e.g., an input operating frequency) by the input image data IDAT. The inversion policy setting unit 220 may generate the inversion control signal ICS by analyzing the input operating frequency. The inversion policy setting unit 220 may examine the input operating frequency by analyzing the input control signal ICONT including information associated with the input operating frequency. For example, the number N may increase when the input operating frequency increases, and the number N may decrease when the input operating frequency decreases.

In some exemplary embodiments, the number N may be changed based on both the type of the image displayed on the display panel 100 and the operating frequency of the display panel 100.

In some exemplary embodiments, the number N may be dynamically changed by a lapse of time. For example, the number N may be adaptively changed based on at least one of the type of the image displayed on the display panel 100 by the output image data DAT and the operating frequency of the display panel 100 by the input image data IDAT.

In an exemplary embodiment, a lapse of time may increase the number N. For example, when a static image is displayed for a long period of time the inversion policy setting unit of the timing controller may respond by decreasing the number N. This may reduce the operating frequency of the display panel 100.

The control signal generator 240 may receive the input control signal ICONT. The control signal generator 240 may generate the first control signal CONT1 for the gate driver 300 and the second control signal CONT2 for the data driver 400 based on the input control signal CONT. The control signal generator 240 may output the first control signal CONT1 to the gate driver 300 and may output the second control signal CONT2 to the data driver 400.

In an exemplary embodiment, the inversion policy setting unit 220 and the polarity control signal generator 230 may be included in the control signal generator 240. In this embodiment the polarity control signal REV may be one of a plurality of signals included in the second control signal CONT2.

FIGS. 3, 4A, 4B, 5, 6, 7, 8 and 9 are diagrams for describing an operation of the display apparatus according to exemplary embodiments.

Figure 3:
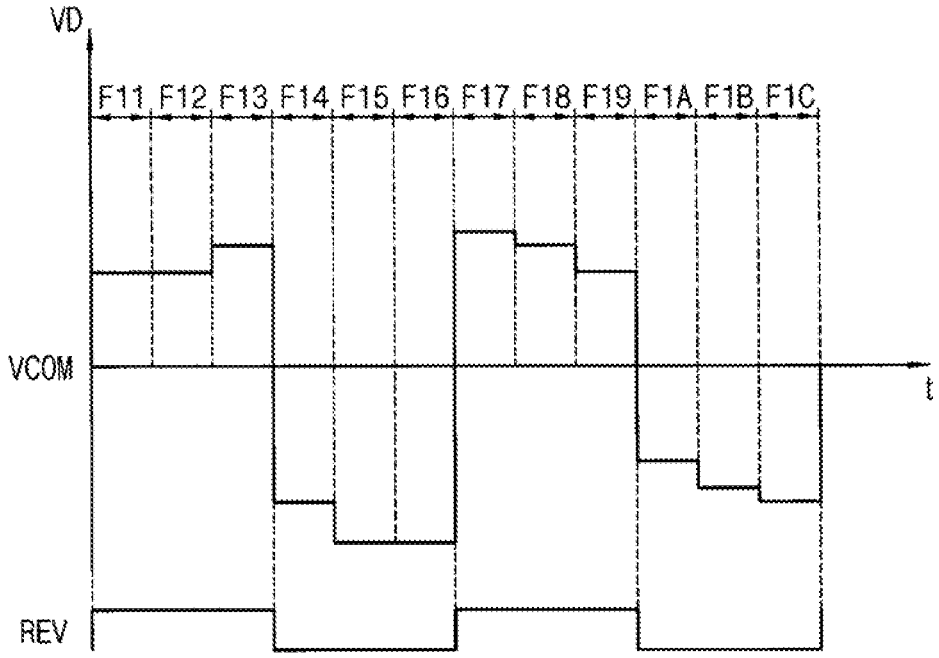
FIG. 3 is a timing diagram illustrating an operation of the timing controller according to exemplary embodiments.
Figure 5:
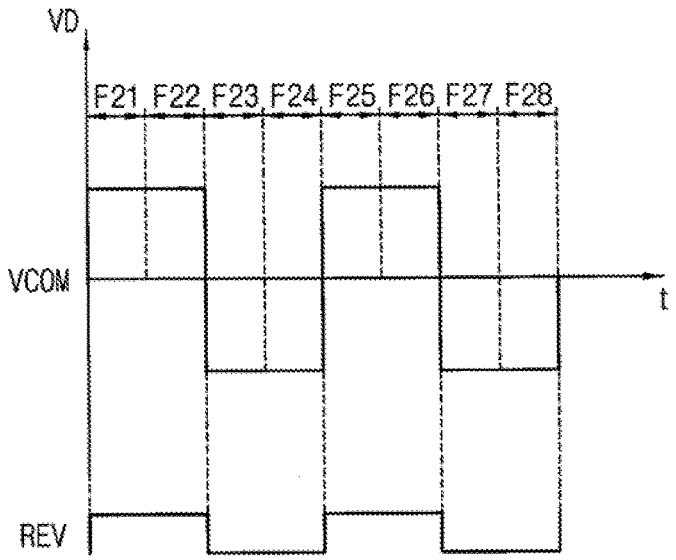
FIGS. 5, 6, 7, 8 and 9 are timing diagrams illustrating an operation of the timing controller according to exemplary embodiments.
Figure 6:
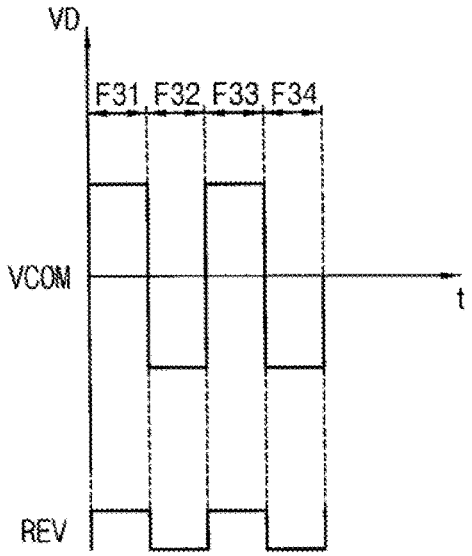
Figure 7:
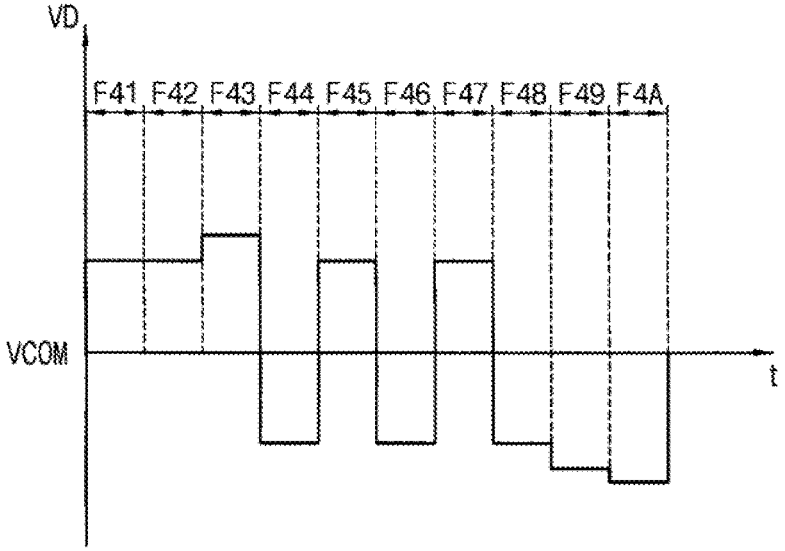
Figure 8:
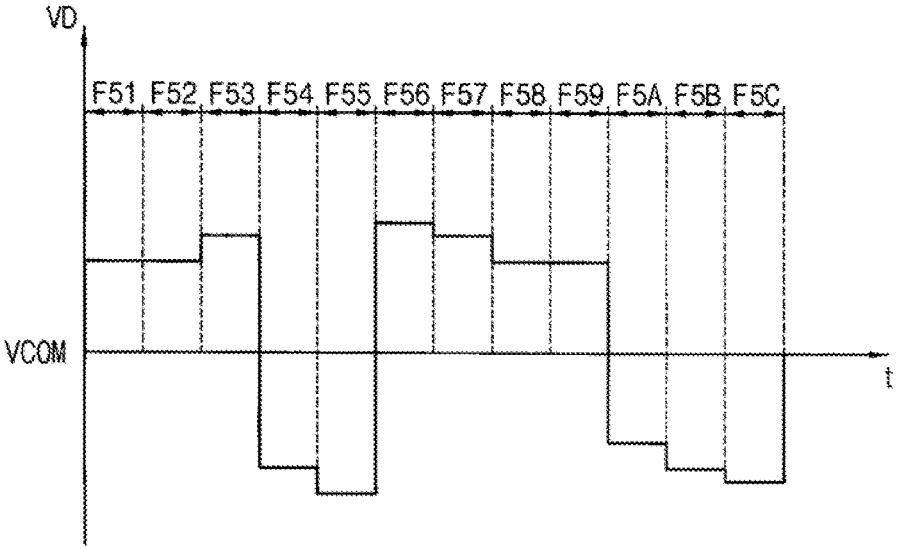
Figure 9:
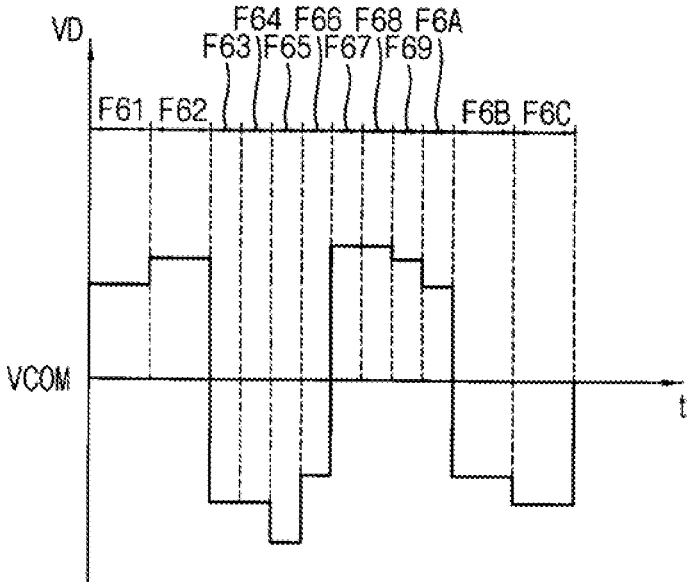

FIG. 3 illustrates an example of a data voltage VD and the polarity control signal REV when the output image data DAT corresponds to a dynamic image. FIGS. 4A and 4B illustrate examples of the polarity pattern of the frame image on the display panel 100. FIG. 5 illustrates an example of the data voltage VD and the polarity control signal REV when the output image data DAT corresponds to a static image including the reference pattern. FIG. 6 illustrates an example of the data voltage VD and the polarity control signal REV when the output image data DAT corresponds to the static image without the reference pattern. FIGS. 7, 8 and 9 illustrate examples of the data voltage VD when the number N is dynamically changed.

In a normal inversion driving scheme, the polarity pattern of the frame images may be changed at every frame, corresponding to an N of one.

In an exemplary embodiment, different polarity patterns may be used for different types of images. A display device may be capable of generating different polarity patterns and the timing controller may select a polarity pattern based on a type of image. For example, the timing controller may select a first polarity pattern based on a type of dynamic image, e.g. a movie. The timing controller may select a second polarity pattern when a different type of dynamic image, e.g. a video game, is detected.

According to exemplary embodiments, in the display apparatus 10 when the output image data DAT corresponds to the dynamic image (e.g., a moving image, a video, etc.), the number N may be greater than one. In other words, as compared with the normal inversion driving scheme, the number N may increase when the display panel 100 displays a dynamic image. The display panel 100 and the display apparatus 10 may have low power consumption as the number N increases.

Referring to FIG. 3, when the output image data DAT corresponds to the dynamic image, the display panel 100 may display first frame images during the first frames F11, F12 and F13 and may display second frame images during the second frames F14, F15 and F16 subsequent to the first frames F11-F13. The number of first frame images, the number of first frames F11-F13, the number of second frame images and the number of second frames F14-F16 may be three. In addition, the first frames F11-F13 may be three consecutive frames, and the second frames F14-F16 may also be three consecutive frames. Each of the first frame images may have a first polarity pattern. Each of the second frame images may have a second polarity pattern different from the first polarity pattern.

The timing controller 200 may transition the polarity control signal REV from a first level (e.g., a logic high level) to a second level (e.g., a logic low level) after a time duration (or a time period) corresponding to the beginning and the end of the first frames F11-F13. The timing controller 200 may transition the polarity control signal REV from the second level to the first level after a time duration (or a time period) corresponding to the beginning and the end of the second frames F14-F16.

A data voltage VD applied to a first pixel may have a first polarity (e.g., a positive polarity) with respect to a common voltage VCOM during the first frames F11-F13, and may have a second polarity (e.g., a negative polarity) with respect to the common voltage VCOM during the second frames F14-F16. A different data voltage applied to a second pixel adjacent to the first pixel may have the second polarity with respect to the common voltage VCOM during the first frames F11-F13 and the second pixel may have the first polarity with respect to the common voltage VCOM during the second frames F14-F16. Since the dynamic image is displayed on the display panel 100, a level of the data voltage VD during the first frames F11-F13 may be changed even if a polarity of the data voltage VD during the first frames F11-F13 is maintained. Similarly, a level of the data voltage VD during the second frames F14-F16 may be changed even if a polarity of the data voltage VD during the second frames F14-F16 is maintained.

In some exemplary embodiments, the display panel 100 may have a polarity pattern of a dot inversion where a single pixel is surrounded by pixels having a polarity, which is opposite to that of the single pixel. For example, the first polarity pattern may be a polarity pattern illustrated in FIG. 4A. In FIG. 4A, during the first frames F11-F13, each of first, third, fifth and seventh pixel rows may have a polarity pattern of "+, +, +, +, −", and each of second, fourth, sixth and eighth pixel rows may have a polarity pattern of "−, +, +, +, +". The second polarity pattern may be a reversed polarity pattern of the polarity pattern in FIG. 4A. For example, during the second frames F14-F16 subsequent to the first frames F11-F13, each of the first, third, fifth and seventh pixel rows may have the polarity pattern of "−, +, −, +, −, +, −, +", and each of the second, fourth, sixth and eighth pixel rows may have the polarity pattern of "+, −, +, −, +, −, +, −".

In some exemplary embodiments, the display panel 100 may have a polarity pattern of a line inversion (e.g., a column inversion or a row inversion) where pixels in a single row or column have the same polarity as each other. For example, the first polarity pattern may be a polarity pattern illustrated in FIG. 4B. In FIG. 4B, during the first frames F11-F13, each of first through eighth pixel rows may have a polarity pattern of "+, −, +, −, +, −, +, −". The second polarity pattern may be a reversed polarity pattern of the polarity pattern in FIG. 4B. For example, although not illustrated in FIG. 4B, during the second frames F14-F16 subsequent to the first frames F11-F13, each of the first through eighth pixel rows may have a polarity pattern of "−, +, −, +, −, +, −+".

In an exemplary embodiment, the display panel 100 may have a polarity pattern of a dot inversion where two, three or six pixels have the same polarity with each other and are surrounded by pixels having the opposite polarity. Alternatively, the display panel 100 may have a polarity pattern of a line inversion where pixels in two or three adjacent pixel rows or columns have the same polarity as each other.

Referring back to FIG. 3, similarly to the operation during the first and second frames F11-F16, the display panel 100 may display third frame images during third frames F17, F18 and F19 subsequent to the second frames F14-F16 and may display fourth frame images during fourth frames F1A, F1B and F1C subsequent to the third frames F17-F19. The number of the third frame images, the number of third frames F17-F19, the number of the fourth frame images and the number of fourth frames F1A-F1C may also be three. In addition, the third frames F17-F19 may be three consecutive frames, and the fourth frames F1A-F1C may be three consecutive frames. Each of the third frame images may have the first polarity pattern, and each of the fourth frame images may have the second polarity pattern. The timing controller 200 may transition the polarity control signal REV from the first level to the second level after a time duration corresponding to the beginning to the end of the third frames F17-F19. The timing controller 200 may transition the polarity control signal REV from the second level to the first level after a time duration corresponding to the beginning to the end of the fourth frames F1A-F1C. The data voltage VD may have the first polarity with respect to the common voltage VCOM during the third frames F17-F19, and may have the second polarity with respect to the common voltage VCOM during the fourth frames F1A-F1C.

Although FIG. 3 illustrates the example where the number N is three, N may be any natural number greater than one when the output image data DAT corresponds to the dynamic image.

According to an exemplary embodiments, in the display apparatus 10, when the output image data DAT corresponds to the static image (e.g., a still image, a stopped image, etc.) including the reference pattern (e.g., a predetermined test pattern, a pattern required to reduce power consumption, etc.), the number N may be greater than one. Compared with the normal inversion driving scheme, the number N may increase when the display panel 100 displays the static image including the reference pattern. The display panel 100 and the display apparatus 10 may have low power consumption as the number N increases.

Referring to FIG. 5, when the output image data DAT corresponds to the static image including the reference pattern, the display panel 100 may display first frame images during first frames F21 and F22 and may display second frame images during second frames F23 and F24 subsequent to the first frames F21-F22. The number of the first frame images, the number of first frames F21-F22, the number of the second frame images and the number of second frames F23-F24 may be two. In addition, the first frames F21-F22 may be two consecutive frames, and the second frames F23-F24 may also be two consecutive frames. Each of the first frame images may have a first polarity pattern, and each of the second frame images may have a second polarity pattern different from the first polarity pattern.

The timing controller 200 may transition the polarity control signal REV from a first level (e.g., a logic high level) to a second level (e.g., a logic low level) after a time duration (or a time period) corresponding to the beginning and the end of the first frames F21-F22, and may transition the polarity control signal REV from the second level to the first level after a time duration (or a time period) corresponding to the beginning and the end of the second frames F23-F24.

A data voltage VD applied to a first pixel may have a first polarity (e.g., a positive polarity) with respect to a common voltage VCOM during the first frames F21-F22, and may have a second polarity (e.g., a negative polarity) with respect to the common voltage VCOM during the second frames F23-F24. A different data voltage applied to a second pixel adjacent to the first pixel may have the second polarity with respect to the common voltage VCOM during the first frames F21-F22. The second pixel may have the first polarity with respect to the common voltage VCOM during the second frames F23-F24. Since the static image is displayed on the display panel 100, a level of the data voltage VD during the first frames F21-F22 may not be changed, and a level of the data voltage VD during the second frames F23-F24 may not be changed.

In some exemplary embodiments, the display panel 100 may have a polarity pattern of a dot inversion where a single pixel is surrounded by pixels having a polarity, which is opposite to that of the single pixel, or a polarity pattern of a dot inversion where two, three or six pixels have the same polarity with each other and are surrounded by pixels having the opposite polarity. Alternatively, the display panel 100 may have a polarity pattern of a line inversion where pixels in a single row or column have the same polarity as each other, or a polarity pattern of a line inversion where pixels in two or three adjacent pixel rows or columns have the same polarity as each other.

Similarly to the operation during the first and second frames F21-F24, the display panel 100 may display third frame images during the third frames F25 and F26 subsequent to the second frames F23-F24. The display panel 100 may display fourth frame images during fourth frames F27 and F28 subsequent to the third frames F25-F26. The number of the third frame images, the number of third frames F25-F26, the number of the fourth frame images and the number of fourth frames F27-F28 may also be two. In addition, the third frames F25-F26 may be two consecutive frames, and the fourth frames F27-F28 may be two consecutive frames. Each of the third frame images may have the first polarity pattern, and each of the fourth frame images may have the second polarity pattern. The timing controller 200 may transition the polarity control signal REV from the first level to the second level after a time duration corresponding to the beginning and the end of the third frames F25-F26. The timing controller 200 may transition the polarity control signal REV from the second level to the first level after a time duration corresponding to the beginning and the end of the fourth frames F27-F28. The data voltage VD may have the first polarity with respect to the common voltage VCOM during the third frames F25-F26, and may have the second polarity with respect to the common voltage VCOM during the fourth frames F27-F28.

Although FIG. 5 illustrates the example where the number N is two, the number N may be any natural number greater than one when the output image data DAT corresponds to the static image including the reference pattern.

In some exemplary embodiments, the number N for the dynamic image may be equal to or greater than the number N for the static image including the reference pattern. In other words, as compared with the normal inversion driving scheme, the number N may increase when the display panel 100 displays one of the dynamic image and/or the static image including the reference pattern. However, the number N for the dynamic image may increase more because it is noted that the static image may be prone to an afterimage (e.g., a residual image based on a residual DC voltage) as compared to the dynamic image.

According to exemplary embodiments, in the display apparatus 10, when the output image data DAT corresponds to the static image without the reference pattern, the number N may be one. In other words, the number N may not change when the display panel 100 displays the static image without the reference pattern.

Referring to FIG. 6, when the output image data DAT corresponds to the static image without the reference pattern, the display panel 100 may display a first frame image during a first frame F31 and may display a second frame image during a second frame F32 subsequent to the first frame F31. The first frame image may have a first polarity pattern, and the second frame image may have a second polarity pattern different from the first polarity pattern. The timing controller 200 may transition the polarity control signal REV from a first level (e.g., a logic high level) to a second level (e.g., a logic low level) after a time duration (or a time period) corresponding to the first frame F31 is elapsed, and may transition the polarity control signal REV from the second level to the first level after a time duration (or a time period) corresponding to the second frame F32 is elapsed.

Similarly to the operation during the first and second frames F31-F32, the display panel 100 may display a third frame image during a third frame F33 subsequent to the second frame F32 and may display a fourth frame image during a fourth frame F34 subsequent to the third frame F33. The third frame image may have the first polarity pattern, and the fourth frame image may have the second polarity pattern. The timing controller 200 may transition the polarity control signal REV from the first level to the second level after a time duration corresponding to the beginning and the end of the third frame F33, and may transition the polarity control signal REV from the second level to the first level after a time duration corresponding to the beginning and the end of the fourth frame F34.

A data voltage VD applied to a first pixel may have a first polarity (e.g., a positive polarity) with respect to a common voltage VCOM during the first and third frames F31 and F33, and may have a second polarity (e.g., a negative polarity) with respect to the common voltage VCOM during the second and fourth frames F32 and F34. In some exemplary embodiments, the display panel 100 may have one of various polarity patterns of a dot inversion or one of various polarity patterns of a line inversion.

According to an exemplary embodiment, the display apparatus 10, the number N may be dynamically changed by a lapse of time, based on the type of the image displayed by the output image data DAT.

Referring to FIG. 7, the display apparatus 10 may display a first dynamic image during frames F41, F42 and F43, may display a first static image during frames F44, F45, F46 and F47, and may display a second dynamic image during frames F48, F49 and F4A. In the example of FIG. 7, the number N may be three in the frames F41-F43, may be one in the frames F44-F47, and may be three in the frames F48-F4A. In FIG. 7, the number N may be changed in an order of three, one and three. The number N may increase when the image displayed by the output image data DAT is changed from the static image to the dynamic image (e.g., at a beginning time of the frame F48). The number N may decrease when the image displayed by the output image data DAT is changed from the dynamic image to the static image (e.g., at a beginning time of the frame F44).

Referring to FIG. 8, the display apparatus 10 may display a first dynamic image during frames F51-F59, F5A, F5B and F5C. In the example of FIG. 8, the number N may be three in the frames F51-F53, may be two in the frames F54-F55, may be four in the frames F56-F59, and may be three in the frames F5A-F5C. In FIG. 8, the number N may be changed in an order of three, two, four and three. Even if the image displayed by the output image data DAT is maintained as the dynamic image, the number N may increase or decrease based on changes in grayscales of the dynamic image.

According to an exemplary embodiment, the display apparatus 10, the number N may be dynamically changed by a lapse of time, based on the operating frequency of the display panel 100 (e.g., the input operating frequency) by the input image data IDAT.

Referring to FIG. 9, the operating frequency of the display panel 100 may be a first frequency during frames F61 and F62. The operating frequency may be a second frequency different from the first frequency during frames F63-F69 and F6A. The operating frequency may be substantially similar to the first frequency during frames F6B and F6C. For example, the first frequency may be about 60 Hz, and the second frequency may be about 120 Hz. In the example of FIG. 9, the number N may be two in the frames F61-F62, may be four in the frames F63-F6A, and may be two in the frames F6B-F6C. In other words, in FIG. 9, the number N may be changed from two to four and back to two. The number N may increase when the operating frequency of the display panel 100 increases (e.g., at a beginning time of the frame F63). The number N may decrease when the operating frequency of the display panel 100 decreases (e.g., at a beginning time of the frame F6B).

According to an exemplary embodiment, in the display apparatus 10, the display panel 100 may operate based on the inversion driving scheme in which the polarity pattern of the frame images is changed per N frames. The number N may be variable based on the type of the image displayed on the display panel 100 and/or the operating frequency of the display panel 100.

Figure 10:
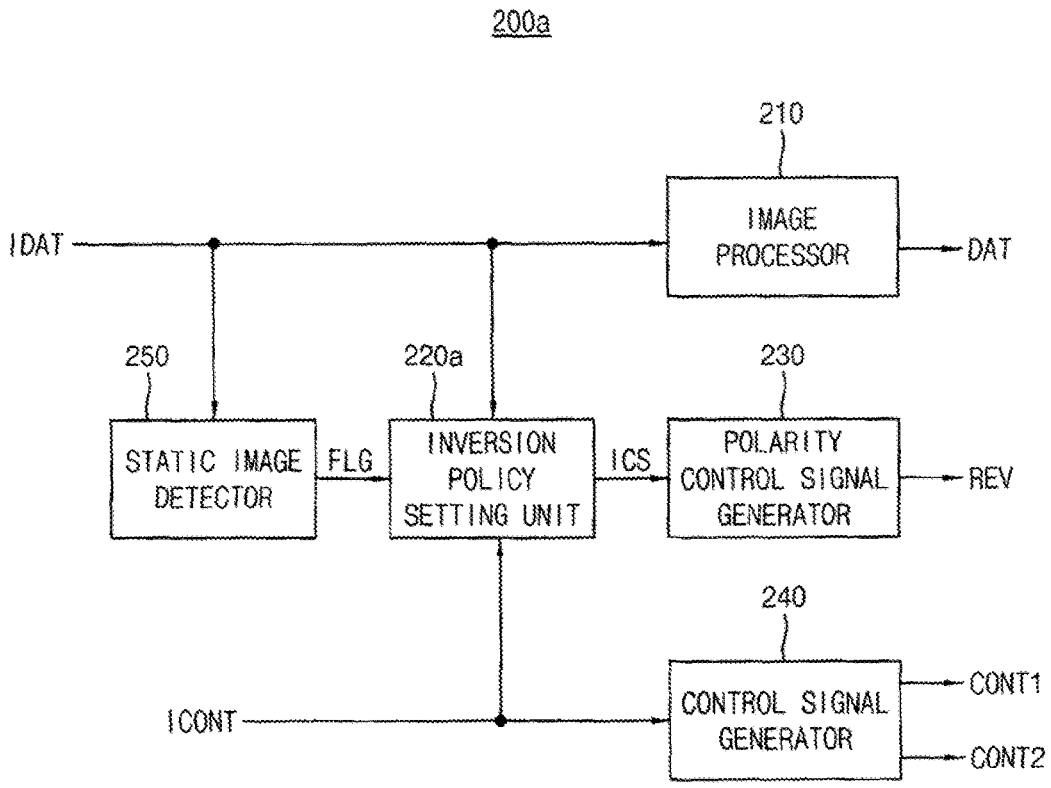
FIGS. 10 and 11 are block diagrams illustrating a timing controller included in the display apparatus according to exemplary embodiments.
Figure 11:
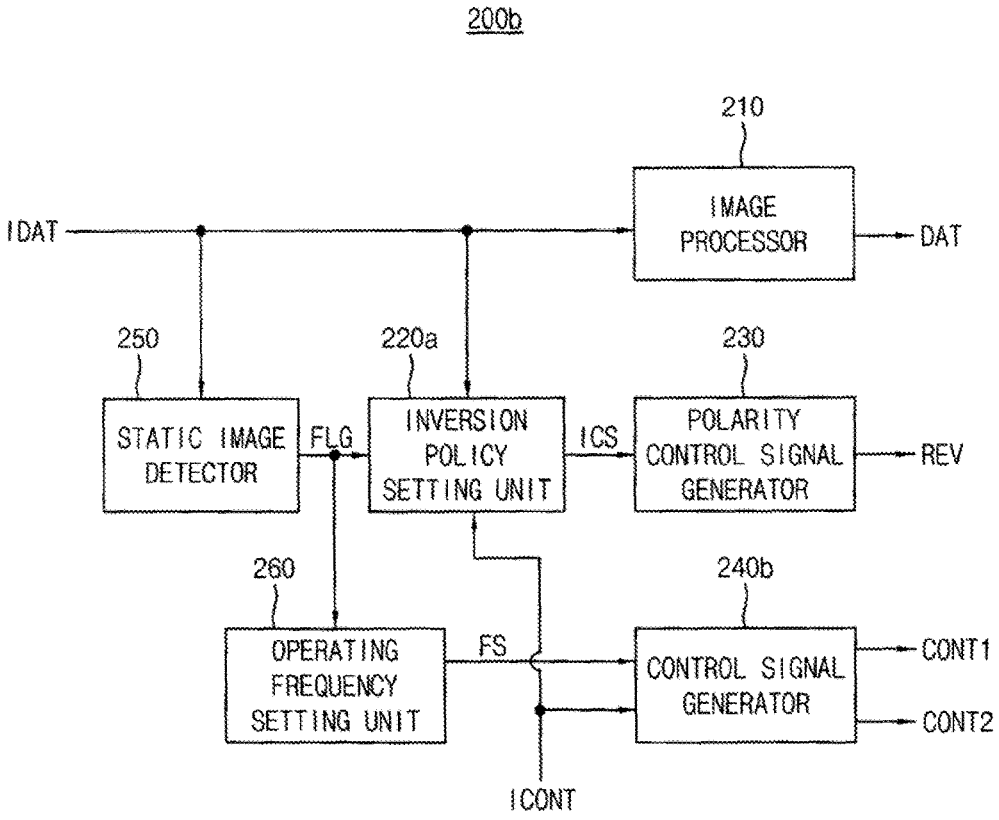

FIGS. 10 and 11 are block diagrams illustrating a timing controller included in the display apparatus according to exemplary embodiments.

Referring to FIG. 10, a timing controller 200*a* may include an image processor 210, an inversion policy setting unit 220*a*, a polarity control signal generator 230, a control signal generator 240 and a static image detector 250.

The timing controller 200*a* of FIG. 10 may be substantially the same as the timing controller 200 of FIG. 2, except that the timing controller 200*a* of FIG. 10 further includes the static image detector 250, and that the inversion policy setting unit 220*a* in FIG. 10 is partially different from the inversion policy setting unit 220 in FIG. 2.

The static image detector 250 may determine whether the output image data DAT (e.g., the input image data IDAT corresponding to the output image data DAT) corresponds to a static image or a dynamic image. The static image detector 250 may generate a flag signal FLG when the output image data DAT corresponds to the static image.

The inversion policy setting unit 220*a* may generate an inversion control signal ICS based on the flag signal FLG and at least one of the input image data IDAT and the input control signal ICONT. The polarity control signal generator 230 may generate the polarity control signal REV based on the inversion control signal ICS.

The polarity pattern of the frame images displayed on the display panel 100 may be changed (e.g., reversed) based on the polarity control signal REV per N frames. The timing controller 200 may change the number N by adjusting a transition time of the polarity control signal REV based on the inversion control signal ICS.

In some exemplary embodiments, the number N may be changed based on a type of an image displayed on the display panel 100 according to the image data DAT.

For example, the inversion policy setting unit 220*a* may determine that the output image data DAT corresponds to the dynamic image when the flag signal FLG is not received from the static image detector 250, and may determine that the output image data DAT corresponds to the static image when the flag signal FLG is received from the static image detector 250. The inversion policy setting unit 220*a* may further determine whether the static image includes a reference pattern. The inversion policy setting unit 220*a* may generate the inversion control signal ICS based on the determination results. The number N may be changed based on the inversion control signal ICS.

In some exemplary embodiments, the number N may be changed based on an operating frequency of the display panel 100 (e.g., an input operating frequency) by the input image data IDAT. The inversion policy setting unit 220*a* may generate the inversion control signal ICS by analyzing the input operating frequency. The inversion policy setting unit 220*a* may obtain the input operating frequency by analyzing the input control signal ICONT including information associated with the input operating frequency.

In some exemplary embodiments, the number N may be changed based on both the type of the image displayed on the display panel 100 by the output image data DAT and the operating frequency of the display panel 100 by the input image data IDAT.

In some exemplary embodiments, the number N may be dynamically changed by a lapse of time. For example, the number N may be adaptively changed based on at least one of the type of the image displayed on the display panel 100 and the operating frequency of the display panel 100.

The image processor 210 may generate the output image data DAT by performing at least one image compensation on input image data IDAT. The control signal generator 240 may generate the first control signal CONT1 and the second control signal CONT2 based on the input control signal CONT.

Referring to FIG. 11, a timing controller 200*b* may include an image processor 210, an inversion policy setting unit 220*a*, a polarity control signal generator 230, a control signal generator 240*b*, a static image detector 250 and an operating frequency setting unit 260.

The timing controller 200*b* of FIG. 11 may be substantially the same as the timing controller 200*a* of FIG. 10, except that the timing controller 200*b* of FIG. 11 further includes the operating frequency setting unit 260, and that the control signal generator 240*b* in FIG. 11 is partially different from the control signal generator 240*a* in FIG. 10.

The operating frequency setting unit 260, e.g. the operating frequency setting circuit, may generate a frequency setting signal FS indicating an operating frequency of the display panel 100 based on a flag signal FLG. When the flag signal FLG is not received from the static image detector 250, the operating frequency setting unit 260 may set the operating frequency of the display panel 100 as a first frequency because it may be determined that the output image data DAT corresponds to a dynamic image. When the flag signal FLG is received from the static image detector 250, the operating frequency setting unit 260 may change the operating frequency of the display panel 100 from the first frequency to a second frequency lower than the first frequency because it may be determined that the output image data DAT corresponds to a static image. For example, the first frequency may be about 60 Hz, and the second frequency may be about 30 Hz.

The control signal generator 240*b* may receive the input control signal ICONT. The control signal generator 240*b* may generate the first control signal CONT1 for the gate driver 300 and the second control signal CONT2 for the data driver 400 based on the input control signal CONT and the operating frequency of the display panel 100 (e.g., the frequency setting signal FS). The control signal generator 240*b* may output the first control signal CONT1 to the gate driver 300 and may output the second control signal CONT2 to the data driver 400.

Figure 12:
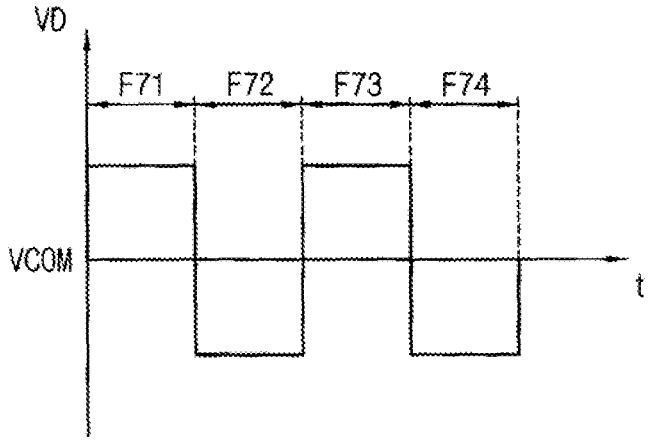
FIG. 12 is a diagram for describing an operation of the display apparatus according to exemplary embodiments.

FIG. 12 is a diagram for describing an operation of the display apparatus according to exemplary embodiments. FIG. 12 illustrates an example of change in the operating frequency of the display panel 100 by the timing controller 200*b* of FIG. 11.

Referring to FIG. 12, when the output image data DAT corresponds to the static image, the display panel 100 may display a first frame image during a first frame F71, may display a second frame image during a second frame F72 subsequent to the first frame F71, may display a third frame image during a third frame F73 subsequent to the second frame F72, and may display a fourth frame image during a fourth frame F74 subsequent to the third frame F73. Each of the first and third frame images may have a first polarity pattern, and each of the second and fourth frame images may have a second polarity pattern different from the first polarity pattern.

A data voltage VD applied to a first pixel may have a first polarity (e.g., a positive polarity) with respect to a common voltage VCOM during the first and third frames F71 and F73, and may have a second polarity (e.g., a negative polarity) with respect to the common voltage VCOM during the second and fourth frames F72 and F74. In some exemplary embodiments, the display panel 100 may have one of various polarity patterns of a dot inversion or one of various polarity patterns of a line inversion.

In the example of FIG. 3 where the display panel 100 displays the dynamic image, the operation frequency of the display apparatus 100 may be set as the first frequency (e.g., about 60 Hz). In the example of FIG. 12 where the display panel 100 displays the static image, the operation frequency of the display apparatus 100 may be set as the second frequency (e.g., about 30 Hz). Since the operation frequency of the display apparatus 100 decreases in FIG. 12, a time duration of one frame (e.g., F71) in FIG. 12 may be longer than a time duration of a different frame (e.g., F11) in FIG. 3.

In the display apparatus 10 according to exemplary embodiments, the operation frequency of the display apparatus 100 may decrease when the output image data DAT corresponds to a static image.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings of the present inventive concept. Accordingly, all such modifications are intended to be included within the scope of the present inventive concept as defined in the claims.

What is claimed is:

1. A display apparatus comprising:

a timing controller configured to generate an output image data based on an input image data, and configured to generate a polarity control signal according to the input image data; and a display panel configured to display a plurality of frame images based on the output image data during a plurality of frames, the display panel changes a polarity pattern of the plurality of frame images based on the polarity control signal for each of N frames, and wherein N is any natural number and N varies dynamically based on the polarity control signal, and wherein based on the output image data, the timing controller generates an inversion control signal based on a type of image displayed on the display panel, the type of image being determined from among at least three types of images, and the inversion control signal is generated according to the type of image, and wherein the timing controller generates the polarity control signal based on the inversion control signal, wherein a value of N is changed by adjusting a transition time of the polarity control signal based on the inversion control signal.

2. The display apparatus of claim 1, wherein when the output image data corresponds to a dynamic image, the display panel displays first frame images during first frames and displays second frame images during second frames subsequent to the first frames, wherein there are X first frame images and X first frames, where X is a natural number equal to or greater than two, each of the first frame images has a first polarity pattern, and the X first frames are consecutive, wherein there are Y second frame images and Y second frames, where Y is a natural number equal to or greater than two, each of the second frame images has a second polarity pattern different from the first polarity pattern, and the Y second frames are consecutive.

3. The display apparatus of claim 2, wherein when the output image data corresponds to the dynamic image, the timing controller transitions the polarity control signal from a first level to a second level after a time duration corresponding to the first frames has elapsed, and transitions the polarity control signal from the second level to the first level after a time duration corresponding to the second frames has elapsed.

4. The display apparatus of claim 2, wherein when the output image data corresponds to a static image including a reference pattern, the display panel displays first frame images during first frames and displays second frame images during second frames, the second frames are subsequent to the first frames, wherein each of the X first frame images have a first polarity pattern, the X first frames are consecutive, and X is a natural number equal to or greater than two, wherein each of the Y second frame images have a second polarity pattern different from the first polarity pattern, Y second frames are consecutive, and where Y is a natural number equal to or greater than two.

5. The display apparatus of claim 1, wherein when the output image data corresponds to a static image, the display panel displays a first frame image during a first frame and displays a second frame image during a second frame subsequent to the first frame, wherein the first frame image has a first polarity pattern, and the second frame image has a second polarity pattern different from the first polarity pattern.

6. The display apparatus of claim 5, wherein when the output image data corresponds to the static image, the timing controller changes an operating frequency of the display panel from a first frequency to a second frequency, the second frequency is lower than the first frequency.

7. The display apparatus of claim 1, wherein N is dynamically changed by a lapse of time.

8. The display apparatus of claim 7, wherein the timing controller generates the polarity control signal based on a type of a first image displayed on the display panel by the output image data, wherein N increases when the first image is changed from a static image to a dynamic image, and N decreases when the first image is changed from the dynamic image to the static image, and the dynamic image includes at least one of a video game image and a moving image, having a respectively different polarity control signal.

9. The display apparatus of claim 7, wherein the timing controller generates the polarity control signal based on an operating frequency of the display panel, wherein N increases when the operating frequency of the display panel increases, and N decreases when the operating frequency of the display panel decreases.

10. The display apparatus of claim 1, wherein the timing controller includes:

an inversion policy setting circuit configured to generate an inversion control signal based on at least one of a type of an image displayed on the display panel by the output image data and an operating frequency of the display panel by the input image data; and a polarity control signal generator configured to generate the polarity control signal based on the inversion control signal, wherein the inversion policy setting circuit is configured to determine the type of an image by analyzing the input image data, and wherein N is changed by adjusting a transition time of the polarity control signal based on the inversion control signal.

11. The display apparatus of claim 10, wherein the timing controller further includes:

an operating frequency setting circuit configured to change an operating frequency of the display panel from a first frequency to a second frequency, wherein the second frequency is lower than the first frequency when the output image data corresponds to a static image.

12. A display apparatus comprising:

a timing controller configured to generate an output image data based on an input image data, and configured to generate a polarity control signal by analyzing the input image data; and a display panel configured to display a plurality of frame images based on the output image data during a plurality of frames, the display panel changes a polarity pattern of the plurality of frame images based on the polarity control signal for each of N frames, and wherein N is a natural number and varies based on the polarity control signal, wherein the timing controller includes:

an inversion policy setting circuit configured to generate an inversion control signal based on at least one of a type of an image displayed on the display panel by the output image data and an operating frequency of the display panel by the input image data; and a polarity control signal generator configured to generate the polarity control signal based on the inversion control signal, wherein the inversion policy setting circuit is configured to determine the type of an image by analyzing the input image data, wherein N is changed by adjusting a transition time of the polarity control signal based on the inversion control signal, and a static image detector configured to generate a flag signal to provide the flag signal to the inversion policy setting circuit when the output image data corresponds to a static image.

13. A method of operating a display apparatus, the method comprising:

generating output image data based on an input image data;

generating a polarity control signal by analyzing the input image data; and displaying a plurality of frame images on a display panel during a plurality of frames, the display panel changes a polarity pattern of the plurality of frame images based on the polarity control signal for each of N frames, wherein N is a natural number that varies dynamically based on the polarity control signal, and wherein generating the polarity control signal includes:

generating an inversion control signal based on a type of an image displayed on the display panel by the output image data, the type of an image being determined from among at least three types of images, and the inversion control signal is generated according to the type of image; and generating the polarity control signal based on the inversion control signal, wherein N is changed by adjusting a transition time of the polarity control signal based on the inversion control signal.

14. The method of claim 13, wherein when the output image data corresponds to a dynamic image, or when the output image data corresponds to a static image including a reference pattern, the display panel displays first frame images during first frames and displays second frame images during second frames, the second frames are subsequent to the first frames, wherein there are X first frame images and X first frames, each of the X first frame images have a first polarity pattern, the X first frames are consecutive, and X is a natural number equal to or greater than two, wherein there are Y second frame images and Y second frames, each of the Y second frame images have a second polarity pattern different from the first polarity pattern, Y second frames are consecutive, and where Y is a natural number equal to or greater than two.

15. A display apparatus comprises, an image processor configured to generate an output image data based on an input image data;

an inversion policy setting circuit configured to generate an inversion control signal based on at least one of the input image data and an input control signal;

a polarity control signal generator configured to generate a polarity control signal by analyzing the input image data;

a control signal generator configured to generate a first control signal and a second control signal based on the input control signal;

a gate driver configured to receive the first control signal and to generate a plurality of gate signals, the gate driver applies the plurality of gate signals to a plurality of gate lines of a display panel; and a data driver configured to receive the second control signal, the polarity control signal and the output image data and to generate a plurality of data voltages, the data driver applies the plurality of data voltages to a plurality of data lines of the display panel, and wherein the display panel is configured to change a polarity pattern of a plurality of frame images based on the polarity control signal for each of N frames, and wherein N is a natural number and varies dynamically based on the polarity control signal, and wherein based on the output image data, the inversion policy setting circuit generates the inversion control signal based on a type of image displayed on the display panel, the type of image being determined from among at least three types of images, and the inversion control signal is generated according to the type of image, and wherein the polarity control signal generator generates the polarity control signal based on the inversion control signal, wherein a value of N is changed by adjusting a transition time of the polarity control signal based on the inversion control signal.

16. The display apparatus of claim 15, wherein the inversion policy setting circuit is configured to detect whether a type of image is one of a dynamic image or a static image based on the input image data or the input control signal, and to change the inversion control signal based on the type of image detected.

17. The display apparatus of claim 15, wherein the inversion policy setting circuit is configured to change a value of N if an image transmitted by the output image data has not been modified for a period of time.

* * * * *